United States Patent [19]

Cooke et al.

[11] Patent Number: 4,624,794

[45] Date of Patent: Nov. 25, 1986

[54] COMPOSITIONS AND PROCESS FOR TREATING TEXTILES

[75] Inventors: David J. Cooke, Pentyrch; Brian J. Griffiths, Coytrahen; Vivian B. John; George C. Sawicki, both of Penarth, all of England

[73] Assignee: Dow Corning, Ltd., Barry, Wales

[21] Appl. No.: 737,592

[22] Filed: May 24, 1985

[30] Foreign Application Priority Data

Jun. 2, 1984 [GB] United Kingdom ..... 8414113

[51] Int. Cl.[4] ..... D06M 11/00

[52] U.S. Cl. ..... 252/8.8

[58] Field of Search ..... 252/8.8

[56] References Cited

U.S. PATENT DOCUMENTS

| | | | |
|---|---|---|---|
| 4,255,484 | 3/1981 | Stevens | 252/8.8 |
| 4,399,045 | 8/1983 | Burns | 252/8.8 |
| 4,399,247 | 8/1983 | Ona et al. | 252/8.8 |
| 4,427,815 | 1/1984 | Ona et al. | 252/8.8 |
| 4,448,810 | 5/1984 | Westall | 252/8.8 |
| 4,541,936 | 9/1985 | Ona et al. | 252/8.8 |

FOREIGN PATENT DOCUMENTS 1549180 7/1979 United Kingdom .

*Primary Examiner*—Prince E. Willis
*Assistant Examiner*—Willie J. Thompson
*Attorney, Agent, or Firm*—George A. Grindahl

[57] ABSTRACT

A textile treating composition, useful as a composition for the softening of textiles during the rinse cycle of a laundry operation, comprises a cationic surfactant which is substantive to water rinse on textiles and a polydiorganosiloxane having at least one amido containing substitutent, preferably of the formula $$R-NH(CH_2)_2NH\overset{\overset{\displaystyle O}{\|}}{C}CH_3 \text{ or } R-N\overset{\overset{\displaystyle O}{\|}}{C}CH_3(CH_2)_2NH\overset{\overset{\displaystyle O}{\|}}{C}CH_3$$

where R is an alkylene group. The composition is preferably utilized in the form of an aqueous dispersion. A process for treating textile fabrics is also described.

Textile fabrics when treated with this composition exhibit a less greasy feel than prior art textile fabrics and also have an improved rewet time.

17 Claims, No Drawings

COMPOSITIONS AND PROCESS FOR TREATING TEXTILES

This invention relates to compositions for the treatment of textiles to impart desirable properties such as softness thereto. It also relates to a process for treating textiles with the said compositions and also to textiles when treated with a composition according to this invention.

Textile treating compositions for imparting softness to fabrics during or following laundering have been available commercially for many years. Such materials are known for example as 'softeners', 'fabric softeners' and are applied during laundering generally at the rinse cycle stage, when they are added to the rinse water, or during the drying cycle, when they are used in the dry mode, for example as an impregnant in a woven or nonwoven fabric strip. The main active constituents of such softening compositions are substantially water-insoluble cationic surface active substances having large alkyl groups in the molecule. Typical of such materials are di(hydrogenated tallow) dimethyl ammonium chlorides, diamido alkoxylated quaternary ammonium compounds and quaternised amido imidazolines.

It has been disclosed in British Pat. No. 1 549 180 that substantial additional benefits, e.g. easier ironing and more pleasant handle, can be obtained if the said cationic substances are applied to the textile fabric in conjunction with certain silicones. The preferred silicones for use according to the said patent are those having a cationic character and which show an enhanced tendency to deposit on the fabric. It has been found that the amino-functional siloxanes are of particular interest inasmuch as they endow the treated fabric with body and with a silky touch. It has also been found, however, that the use of the amino siloxane increases the time required for the fabric to absorb water after being brought into contact therewith (the rewet time). This reduction in absorbency represents a significant drawback when the textile article is a towel or the like.

We have now discovered that when the amino siloxanes are replaced by certain amido siloxanes in the above-described fabric softening compositions the rewet time is reduced and a dry non-greasy touch is imparted to the fabric.

The invention provides a textile-treating composition which comprises (A) a cationic surfactant which is substantive to water rinse on textile fabrics and (B) a polydiorganosiloxane having in the molecule at least one silicon-bonded group —RX wherein R represents an alkylene group having from 1 to 8 carbon atoms, which may have oxygen or sulphur atoms present in the cabon chain, and X represents an amido-containing organic group selected from $$-NQC(=O)R',\ -C(=O)NR''_2$$

and $-[NZ(CH_2)_n]_p\,NZ(CH_2)_nNZQ$ wherein R' represents a hydrogen atom, an alkyl group having from 1 to 20 carbon atoms, an alkenyl group or an aryl group, each R'' represents a hydrogen atom, an alkyl group having from 1 to 18 carbon atoms or an aryl group, Q represents an alkyl group or a hydrogen atom, each Z represents a hydrogen atom, a lower alkyl group or an $$R'C(=O)-$$

group, wherein R' is as hereinabove defined, at least one Z being a $$R'C(=O)-$$

group, n is a integer of from 2 to 6 and p has a value of 0, 1 or 2, at least 50 percent of the total silicon-bonded substituents in the polydiorganosiloxane being methyl, any remaining silicon-bonded substituents being selected from monovalent hydrocarbon groups having from 2 to 20 carbon atoms, $-RNH_2$ groups, —RCOOH groups and $-R[NH(CH_2)_n]_pNH(CH_2)_nNH_2$ groups.

Also included within the scope of this invention is a process for the treatment of textile fabrics which comprises applying thereto a composition according to the invention. Also included within the scope of this invention are textile fabrics when treated with a composition according to the invention.

As component (A) of the compositions of this invention there may be employed any cationic substance which is substantive to water rinse on textile fabrics and which is capable of imparting softness and/or lubricity to textile fabrics. A large number of such substances are known and include quaternary compounds as follows:

(i) Alkylmethyl quaternary ammonium compounds having either one $C_{18}$–$C_{24}$ alkyl chain or two $C_{12}$–$C_{30}$ alkyl chains, the long chain alkyl groups being most commonly those derived from hydrogenated tallow. Examples of such compounds are ditallowdimethyl ammonium chloride, ditallowdimethyl ammonium methyl sulphate, tallowtrimethyl ammonium chloride, dieicosyldimethyl ammonium chloride, tallowdimethyl(3-tallowalkoxypropyl) ammonium chloride, ditetradecyldimethyl ammonium chloride, didodecyldiethyl ammonium acetate and tallowtrimethyl ammonium acetate.

(ii) Amido alkoxylated quaternary ammonium compounds. Quaternary compounds of this type can be prepared from fatty acids or triglycerides and an amine e.g. diethylene triamine. The product is then alkoxylated with ethylene oxide or propylene oxide and quaternised with dimethyl sulphate. Compounds of type (ii) can be represented by the formula

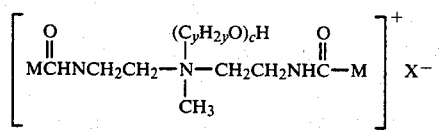

wherein M represents a fatty alkyl group typically $C_{12}$ to $C_{20}$, X represents for example Cl, Br or the methyl sulphate group, y is 2 or 3 and c is an integer.

(iii) Quaternised amido imidazolines. Compounds of this type can be obtained by heating the alkoxylated product of reacting an amine and a fatty acid or triglyceride as described for type (ii) to effect ring closure to the imidazoline. This is then quaternised by reaction with e.g. dimethyl sulphate. An example of a type (iii) compound is 2-heptadecyl-l-methyl-1-(2'-stearoylamido-ethyl)-imidazolinium methyl sulphate.

(iv) Polyamine salts and polyalkylene imine salts e.g. $[C_{12}H_{25}NH(CH_3)—(CH_2)_3—NH_2C_{12}H_{25}]^{++}Cl_2^-$, $[C_{18}H_{37}NH(CH_3)—(CH_2)_2—NH(C_2H_5)_2]^{++}(CH_3SO_4^-)_2$ and a polyethylene iminium chloride having about 10 ethylene imine units.

(v) Alkyl pyridinium salts e.g. cetyl pyridinium chloride.

The generally preferred cationic softening agents are those having long chain, fatty alky groups derived from tallow or hydrogenated tallow and the generally preferred class of softening agents are those of type (i), that is the alkyldimethyl ammonium compounds.

Fabric conditioning agents which may be employed as component (A) of the compositions of this invention are well-known substances and have been widely described in the technical literature, see for example, J. Am. Oil Chemists Soc., January 1978 (Vol 55), pages 118–121 and Chemistry and Industry, 5th July 1969, pages 893–903.

Polydiorganosiloxanes employed as component (B) of the compositions of this invention may be linear (unbranched) or substantially linear siloxane polymers having at least one silicon-bonded —RX group in the molecule. The group X may be $$-NQ\overset{O}{\overset{\|}{C}}R'$$

wherein R′ represents e.g. H, methyl, ethyl, propyl, octyl, stearyl, vinyl or phenyl, or may be $$-\overset{O}{\overset{\|}{C}}NR''_2$$

wherein R″ represents e.g. hydrogen, methyl, ethyl, butyl, octyl, dodecyl, octadecyl or phenyl, or may be the group $—[NZ(CH_2)_n]_p\ NZ(CH_2)_nNZQ$, wherein Z represents hydrogen or $$R'\overset{O}{\overset{\|}{C}}—,$$

n is an integer of from 2 to 6 and p is 0, 1 or 2. Examples of X groups therefore are $$NH.\overset{O}{\overset{\|}{C}}CH_3,\ -NH\overset{O}{\overset{\|}{C}}C_4H_9,\ -NH.\overset{O}{\overset{\|}{C}}C_8H_{17},\ -\overset{O}{\overset{\|}{C}}NH_2,$$

$$-\overset{O}{\overset{\|}{C}}NH(C_4H_9),\ -\overset{O}{\overset{\|}{C}}NH(C_{18}H_{37}),\ -\overset{O}{\overset{\|}{C}}N(C_2H_5)_2,$$

$$-NC(CH_3)(CH_2)_2NH\overset{O}{\overset{\|}{C}}CH_3,\ -NH(CH_2)_2NH\overset{O}{\overset{\|}{C}}CH_3,$$

$$-NC(CH_3)(CH_2)_6NH\overset{O}{\overset{\|}{C}}C_2H_5,\ -NH(CH_2)_2NH\overset{O}{\overset{\|}{C}}C_{17}H_{35},$$

$$-NH(CH_2)_4NH\overset{O}{\overset{\|}{C}}C_6H_5 \text{ and}$$

$$-NH(CH_2)_2N\overset{O}{\overset{\|}{C}}CH_3.(CH_2)_2NH\overset{O}{\overset{\|}{C}}CH_3.$$

At least 50 percent of the silicon-bonded substituents in the polydiorganosiloxane (B) should be methyl groups, any substituents present in addition to the —RX groups and the methyl groups being monovalent hydrocarbon groups having from 2 to 20 carbon atoms or the groups $—RNH_2$, —RCOOH and $—R[NH(CH_2)_n]_pNH(CH_2)_nNH_2$. Preferably the —RX substituents provide no more than 25%, most preferably no more than 7.5% of the total number of substituents in the polydiorganosiloxane. The exemplified polydiorganosiloxane comprises 1% RX groups of the total number of substituents in the polydiorganosiloxane. The polydiorganosiloxanes are preferably terminated with triorganosiloxy, e.g. trimethylsiloxy, groups but may be terminated with groups such as hydroxy or alkoxy. Although the polydiorganosiloxanes are preferably those consisting of diorganosiloxane units, with or without triorganosiloxane units, they may contain small proportions of chain-branching units, that is monoorganosiloxy units, and $SiO_2$ units. The molecular size of the polydiorganosiloxanes (B) is not critical and they may vary from freely-flowing liquids to gummy solids. The preferred polydiorganosiloxanes are, however, those having a viscosity in the range of from about $5.10^{-5}$ to about $5.10^{-2}$ $m^2/s$ at 25° C. Such polydiorganosiloxanes are more easily emulsified than the higher viscosity materials.

Polydiorganosiloxanes (B) wherein X represents the group $$-NQ\overset{O}{\overset{\|}{C}}R'$$

may be prepared for example by reacting the corresponding amino-substituted polydiorganosiloxane with an acid or acid anhydride. Depending on the reaction conditions the formation of amide groups may be accompanied by the formation of salt groups at other amine nitrogen atoms, for example as in the X group $$-\overset{+}{N}H_2(CH_2)_2NH\overset{O}{\overset{\|}{C}}CH_3$$
$$\overset{-}{O}COCH_3$$

The presence of such salt groups is not, however, detrimental to the desired effect. Polydiorganosiloxanes (B) wherein X represents the group $$-\overset{O}{\overset{\|}{C}}NR''_2$$

may be obtained by reaction of the corresponding carboxylic-substituted polydiorganosiloxane with ammonia or an amine. Suitable preparative methods are known in the art and are described for example in U.K. Patent Specification Nos. 882 059, 882 061, 788 984 and 1 117 043.

The compositions of this invention may be prepared by mixing components (A) and (B) in the desired proportions. However, the compositions are preferably prepared and employed in the form of aqueous dispersions. Such dispersions may be obtained by mixing preformed dispersions of (A) and (B) or, more conveniently by dispersing (A) in an aqueous emulsion of the polydiorganosiloxane (B). The concentration of active ingredients (A) and (B) present in the aqueous compositions is not narrowly critical and will be determined by considerations of the nature and viscosity of the product desired and its ease of dispersion in an aqueous bath during use. Generally, the preferred aqueous compositions are those containing (A) and (B) in a total weight of from about 5% to about 35% of the compositions. Depending on the effect desired the relative proportions of (A) and (B) employed to form the mixture or dispersion may be varied within wide limits, for example from 0.02 to 100 parts by weight of the cationic surfactant (A) per part by weight of the polydiorganosiloxane (B). Preferably, however, the compositions of this invention comprise from about 1.0 to 40 parts by weight of (A) per part by weight of (B).

The compositions may contain other, optional, ingredients for example emulsifying agents for the polyorganosiloxanes, perfumes, viscosity control agents, optical brighteners and colourants. Particularly preferred optional ingredients of aqueous fabric softener compositions which may be present in the composition of this invention are certain non-ionic emulsifying agents such as the fatty acid esters of monohydric and polyhydric alcohols, for example glycerol monostearate, sorbitan monolaurate and sorbitan mono-oleate. Such esters can be employed in conventional proportions for fabric conditioning compositions, preferably from about 1% to about 5% by weight based on the weight of the aqueous composition.

The compositions of this invention can be employed as fabric conditioners during the rinse or drying cycle of home or commercial laundry operation. For example the compositions may be spread or otherwise coated on to woven or non-woven fabric pieces and the pieces included with the laundered fabrics during the drying cycle in accordance with known techniques. More preferably, however, the compositions are formulated as aqueous dispersions which are then added during the rinsing stage of the laundering process. The concentration of active ingredients (A) and (B) in the rinse water should be sufficient to provide the desired effect and will normally fall within the range from about 5 to about 500 parts by weight of (A) and (B) per million parts of water.

The following examples, in which the parts are expressed by weight and Me represents the methyl group illustrate the invention.

EXAMPLE 1

A fabric softener composition was prepared according to the formulation

| | |
|---|---|
| [1]Arquad 2HT-75 | 58.0 parts |
| Glycerol monostearate | 16.5 parts |
| [2]Empilan NP9 | 2.0 parts |
| NaCl | 1.0 part |
| Water | 922.5 parts |

[1]$R_2NMe_2^+Cl^-$ wherein the R groups are predominantly $C_{16}$ (31%) and $C_{18}$ (64%) alkyl groups (74% by weight dispersion).
[2]A nonylphenyl polyethoxylate.

This composition was prepared by adding the Empilan and NaCl to water, and heating to 60° C. thereafter adding with stirring a pre-heated (60° C.) mixture of Arquad and glycerol monostearate.

To a portion (40 parts) of the fabric softener composition prepared as above was added, with stirring, 1.7 parts of a non-ionic aqueous emulsion containing 35% by weight of a siloxane having the average formula

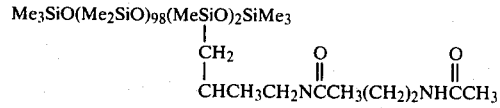

in order to obtain a first example textile treating composition according to the invention, in the form of an aqueous dispersion. 50 g of the textile treating composition thus obtained was diluted with 2 liters of water and the resulting dispersion was acidified with acetic acid to a pH of 6.5. Pieces of prewashed cotton and polyester/cotton fabric, of approximately 400 $cm^2$, were placed in this diluted dispersion for 15 minutes and subjected to intermittent agitation. They were then removed from the diluted dispersion, laid flat for 10 minutes on adsorbent paper to remove excess water and then allowed to dry overnight at ambient temperature (approximately 22° C.) suspended from a line.

For comparison, control pieces of fabric were similarly treated with the fabric softener composition as described hereinabove (i.e. no siloxane component was added). 50 g of the fabric softener composition was added to 2 liters of water.

All of the treated pieces of fabric were softer to the touch compared with untreated fabric. However, fabric pieces according to the invention treated with the textile treating composition according to the invention were drier and less greasy to the touch than the control pieces.

The rewet properties of all the treated fabric pieces were tested by allowing a drop of water to fall on the fabric from a height of approximately 1 cm and measuring the time taken for complete absorption of the drop by the fabric. The results were as follows:

| Pieces of Fabric | Time (seconds) Control | According to the Invention |
|---|---|---|
| Cotton | >300 | 9 |
| Polyester/cotton | 28 | 7 |

EXAMPLE 2

Example 1 was repeated using a second textile treating composition which differed from the first example textile treating composition in that the proportion of siloxane in the textile treating composition was reduced to 0.9 part and the Arquad in the fabric softener composition increased to 45 parts. Fabric pieces were treated as described in Example 1, with a dispersion of the second example textile treating composition diluted as referred to in Example 1.

The rewet times for the treated fabric pieces were:

| | |
|---|---|
| Cotton | 11 seconds |
| Polyester/cotton | 9 seconds |

EXAMPLE 3

A fabric softener composition was prepared according to the formulation

| | |
|---|---|
| Arquad 2HT-75 | 54.0 parts |
| Glycerol monostearate | 20.5 parts |
| Empilan NP 9 | 2.0 parts |

-continued

| | |
|---|---|
| NaCl | 1.0 part |
| Water | 922.5 parts |

The composition was prepared in the same way as that in Example 1.

To a portion (40 parts) of the fabric softener composition prepared as above was added 0.94 part of a non-ionic aqueous emulsion containing 35% by weight of a siloxane having the average formula $$\mathrm{MeSiO(Me_2SiO)_{98}(MeSiO)_2SiMe_3}$$
$$\mathrm{CH_2}$$
$$\mathrm{CHCH_3CH_2NH(CH_2)_2NH\overset{O}{\overset{\|}{C}}CH_3}$$

in order to obtain a third example textile treating composition according to the invention in the form of an aqueous dispersion. The composition thus obtained was used in the same way as the first example textile treating composition for the treatment of fabric pieces. The rewet times were as follows

| | |
|---|---|
| Cotton | 11 seconds |
| Polyester/cotton | 6 seconds |

EXAMPLE 4

Example 3 was repeated using a fourth example textile treating composition which differed from the third example textile treating composition in that the proportion of siloxane was reduced to 0.45 part. Fabric pieces were treated as described in Example 1 with a dispersion of the fourth example textile treating composition diluted as referred to in Example 1. The rewet times for the treated fabric pieces were as follows

| | |
|---|---|
| Cotton | 12 seconds |
| Polyester/cotton | 13 seconds |

That which is claimed is:

1. A textile-treating composition which comprises (A) a cationic surfactant which is substantive to water rinse on textile fabrics and (B) a polydiorganosiloxane having in the molecule at least one silicon-bonded group —RX wherein R represents an alkylene group having from 1 to 8 carbon atoms, which may have oxygen or sulphur atoms present in the carbon chain, and X represents an amido-containing organic group selected from $$\mathrm{-NQ\overset{O}{\overset{\|}{C}}R',\ -\overset{O}{\overset{\|}{C}}NR''_2}$$

and $-[NZ(CH_2)_n]_pNZ(CH_2)_nNZQ$ wherein R′ represents a hydrogen atom, an alkyl group having from 1 to 20 carbon atoms, an alkenyl group or an aryl group, each R″ represents a hydrogen atom, an alkyl group having from 1 to 18 carbon atoms or an aryl group, Q represents an alkyl group or a hydrogen atom, each Z represents a hydrogen atom, a lower alkyl group or an $$\mathrm{R'\overset{O}{\overset{\|}{C}}-}$$

group, wherein R′ is as hereinabove defined, at least one Z being a $$\mathrm{R'\overset{O}{\overset{\|}{C}}-}$$

group, n is an integer of from 2 to 6 and p has a value of 0, 1 or 2, at least 50 percent of the total silicon-bonded substituents in the polydiorganosiloxane being methyl, any remaining silicon-bonded substituents being selected from mono valent hydrocarbon groups having from 2 to 20 carbon atoms, $-RNH_2$ groups, —RCOOH groups and $-R[NH(CH_2)_n]_pNH(CH_2)_nNH_2$ groups.

2. A composition according to claim 1 wherein the RX groups provide not more than 7.5% of the substituents in the polydiorganosiloxane.

3. A composition according to claim 2 wherein the RX groups provide 1% of the substituents in the polydiorganosiloxane.

4. A composition according to claim 1 wherein X represents a group $$\mathrm{\overset{O}{\overset{\|}{N}}CH_3(CH_2)_2NH\overset{O}{\overset{\|}{C}}CH_3}$$

or a group $$\mathrm{NH(CH_2)_2NH\overset{O}{\overset{\|}{C}}CH_3}$$

5. A composition according to claim 1 wherein the polydiorganosiloxane comprises a substantially linear tri-organosiloxy endblocked polysiloxane.

6. A composition according to claim 1 wherein the polydiorganosiloxane has a viscosity in the range from $5.10^{-5}$ to $5.10^{-2}$ $m^2/s$ at 25° C.

7. A composition according to claim 1 in the form of an aqueous dispersion.

8. A composition according to claim 7 comprising from 5 to 35% of (A) and (B) by weight in the total composition.

9. A composition according to claim 1 comprising from 1.0 to 40 parts by weight of (A) per part by weight of (B).

10. A composition according to claim 1 wherein the cationic surfactant comprises one or more of an alkyl methyl quaternary ammonium compound, an amido alkoxylated quaternary ammonium compound, a quaternised amido imidazoline, a quaternary polyamine salt, a quaternary poly alkylene imine salt and an alkyl pyridinium salt.

11. A composition according to claim 10 wherein the cationic surfactant comprises a long chain fatty alkyl group derived from tallow or hydrogenated tallow.

12. A composition according to claim 10 wherein the cationic surfactant comprises dimethyl ditallow ammonium chloride.

13. A composition according to claim 1 comprising also as emulsifying agents one or more of glycerol monostearate, sorbitan monostearate and sorbitan monooleate.

14. A process for the treatment of textiles which comprises applying thereto a composition comprising (A) a cationic surfactant which is substantive to water rinse on textile fabrics and (B) a polydiorganosiloxane having in the molecule at least one silicon-bonded group —RX wherein R represents an alkylene group having from 1 to 8 carbon atoms, which may have oxygen or sulphur atoms present in the carbon chain, and X represents an amido-containing organic group selected from $$-NQ\overset{O}{\overset{\|}{C}}R',\ -\overset{O}{\overset{\|}{C}}NR''_2$$

and $-[NZ(CH_2)_n]_pNZ(CH_2)_nNZQ$ wherein R′ represents a hydrogen atom, an alkyl group having from 1 to 20 carbon atoms, an alkenyl group or an aryl group, each R″ represents a hydrogen atom, an alkyl group having from 1 to 18 carbon atoms or an aryl group, Q represents an alkyl group or a hydrogen atom, each Z represents a hydrogen atom, a lower alkyl group or an $$R'\overset{O}{\overset{\|}{C}}-$$

group, wherein R′ is as hereinabove defined, at least one Z being a $$R'\overset{O}{\overset{\|}{C}}-$$

group, n is an integer of from 2 to 6 and p has a value of 0, 1 or 2, at least 50 precent of the total silicon-bonded substituents in the polydiorganosiloxane being methyl, any remaining silicon-bonded substituents being selected from monovalent hydrocarbon groups having from 2 to 20 carbon atoms, $-RNH_2$ groups, —RCOOH groups and $-R[NH(CH_2)_n]_pNH(CH_2)_NNH_2$ groups.

15. A process according to claim 14 wherein the composition is applied during the rinsing stage of a laundering process.

16. A process according to claim 15 wherein 5 to 500 parts by weight of (A) and (B) per million parts of water are employed in the rinsing stage of a laundering process.

17. A textile fabric when treated with a composition comprising (A) a cationic surfactant which is substantive to water rinse on textile fabrics and (B) a polydiorganosiloxane having in the molecule at least one silicon-bonded group —RX wherein R represents an alkylene group having from 1 to 8 carbon atoms, which may have oxygen or sulphur atoms present in the carbon chain, and X represents an amido-containing organic group selected from $$-NQ\overset{O}{\overset{\|}{C}}R',\ -\overset{O}{\overset{\|}{C}}NR''_2$$

and $-[NZ(CH_2)_n]_pNZ(CH_2)_nNZQ$ wherein R′ represents a hydrogen atom, an alkyl group having from 1 to 20 carbon atoms, an alkenyl group or an aryl group, each R″ represents a hydrogen atom, an alkyl group having from 1 to 18 carbon atoms or an aryl group, Q represents an alkyl group or a hydrogen atom, each Z represents a hydrogen atom, a lower alkyl group or an $$R'\overset{O}{\overset{\|}{C}}-$$

group, wherein R′ is as hereinabove defined, at least one Z being a $$R'\overset{O}{\overset{\|}{C}}-$$

group, n is an integer of from 2 to 6 and p has a value of 0, 1 or 2, at least 50 percent of the total silicon-bonded substituents in the poly diorganosiloxane being methyl, and remaining silicon-bonded substituents being selected from monovalent hydrocarbon groups having from 2 to 20 carbon atoms, $-RNH_2$ groups, —RCOOH groups and $-R[NH(CH_2)_n]_nNH(CH_2$ groups.

* * * * *